US005699714A

United States Patent [19]

Jung et al.

[11] Patent Number: 5,699,714

[45] Date of Patent: Dec. 23, 1997

[54] ADJUSTING SWITCHING DEVICE

[75] Inventors: Rudiger Jung, St. Ingbert; Harald Bär, Volklingen, both of Germany

[73] Assignee: Flutec Fluidtechnische Gerate GmbH, Sulzbach/Saar, Germany

[21] Appl. No.: 614,895

[22] Filed: Mar. 13, 1996

[30] Foreign Application Priority Data

Mar. 29, 1995 [DE] Germany ..... 195 11 522.8

[51] Int. Cl.[6] ..... F15B 11/08

[52] U.S. Cl. ..... 91/439; 91/447; 91/461; 60/468; 60/494

[58] Field of Search ..... 91/446, 447, 437, 91/438, 439, 420, 421, 426, 461; 60/468, 494

[56] References Cited

U.S. PATENT DOCUMENTS 4,362,018 12/1982 Torii ..... 60/468

5,117,950 6/1992 Kobayashi et al. ..... 91/437 X 5,259,293 11/1993 Brunner ..... 60/468 X 5,351,601 10/1994 Zeuner et al. ..... 60/468 X

FOREIGN PATENT DOCUMENTS 3524759 1/1997 Germany .

*Primary Examiner*—Hoang Nguyen

*Attorney, Agent, or Firm*—Roylance,Abrams,Berdo & Goodman,L.L.P

[57] ABSTRACT

A switching device controlling at least one hydraulically operating apparatus has two check valves working in opposition to one another in a feed conduit and a discharge conduit, respectively. The conduits are connected to the operating apparatus, as well as to a pilot valve. Two openable nonreturn valves are connected parallel to the two check valves. The control line of one openable nonreturn valve is connected to the blocking connection of the other openable nonreturn valve. The switching device is especially for controlling a hydraulic cylinder to provide a float setting at low cost, with reliable operation, and with few components.

11 Claims, 1 Drawing Sheet

ADJUSTING SWITCHING DEVICE

FIELD OF THE INVENTION

The present invention relates to a switching device for controlling at least one hydraulically operated apparatus with two nonreturn valves working counter to one another in feed and discharge conduits. The conduits are connected to the relevant operating apparatus as well as to a pilot valve.

BACKGROUND OF THE INVENTION

In connection with the operational apparatus for a hydraulic cylinder, comparable switching devices, as disclosed in German 35 24 759 A1, allow the piston rod in the hydraulic cylinder to move in and out for each operating cycle. Thus, for each cycle, the two nonreturn valves working in opposition to one another are each operated one at a time alternately to obtain flowthrough of the fluid.

Furthermore, openable nonreturn valves are already known which can be opened hydraulically through a control conduit and which are used, for example, for the prevention of leakage or creep movements in cylinders controlled by sliding valves. Such cylinders operate under a load or charge, or for the locking down of stationary system parts which are under pressure, such as extrusion or pressing cylinders. Uncontrolled movements of the user mechanisms when under a load or charge, for example, in the case of pipe breakage or pump breakdown, are to be avoided. These uses are found, among other things, in injection molding machinery, lifting trestles, support cylinders, and mobile and chucking or clamping hydraulic systems which are part of manipulation or maneuvering apparatuses.

With such a range of uses, a hydraulically operated apparatus should be controlled as to movement in different directions. Additionally, in the case of operating apparatuses under a load or charge while the load or charge on the machinery is changing in and of itself, this machinery should be held within a predetermined range of movement in a sort of float setting. This arrangement can be used in agricultural machinery, in which a ground-working apparatus such as a plow is to remain under bias while in engagement with the ground to be worked. The plow is not to rise from this terrain, even if the ground-working apparatus is constrained by the type of terrain or ground surface to undergo a reactive movement. In the case of certain constructions, reactive movements would lead directly to at least temporary raising up of the ground-working apparatus.

SUMMARY OF THE INVENTION

Objects of the present invention involve providing a switching device for controlling at least one hydraulically operated apparatus, which is low cost and operationally reliable, which is float setting for the relevant applicable operating apparatuses, and which has few components.

The foregoing objects are obtained by a switching device for controlling a hydraulically operated apparatus, comprising a feed conduit having a first check valve therein, a discharge conduit having a second check valve therein, and a pilot valve connected to the feed conduit and the discharge conduit. First and second openable, nonreturn valves are connected in parallel to the first and second check valves. Each nonreturn valve has a control conduit, a flowthrough connection and a blocking connection. The control conduit of the first nonreturn valve is connected to the blocking connection of the second nonreturn valve.

Thus, in addition to the raising, lowering and holding of the load with the traditional hydraulically operated apparatus, a float setting too can be realized. Even when the pilot valve has returned to its original position or adjustment setting, the relevant operating apparatus remains in this float setting. If the specific ground-working apparatus generates a disruptive force which thrusts it upward from the ground, as a result of the float setting of the relevant operating apparatus, the disruptive force is received and incorporated and is compensated, such that the ground-working apparatus remains essentially in its working setting.

To attain this float setting by use of the switching device according to the present invention, a specific volume of oil should be introduced through the connection of the control conduit of the first openable nonreturn valve to the blocking connection of the other openable nonreturn valve. This provides permanent and continuous control of the first openable nonreturn valve. In that manner and with that reaction, connection of the fluid-carrying chambers of the hydraulically operating apparatus one after the other in series guarantees counterbalancing of the float setting.

Other objects, advantages and salient features of the present invention will become apparent from the following detailed description, which, taken on conjunction with the annexed drawings, discloses a preferred embodiment of the present invention.

BRIEF DESCRIPTION OF THE DRAWINGS

Referring to the drawings which form a part of this disclosure.

DETAILED DESCRIPTION OF THE INVENTION

Figure 1:
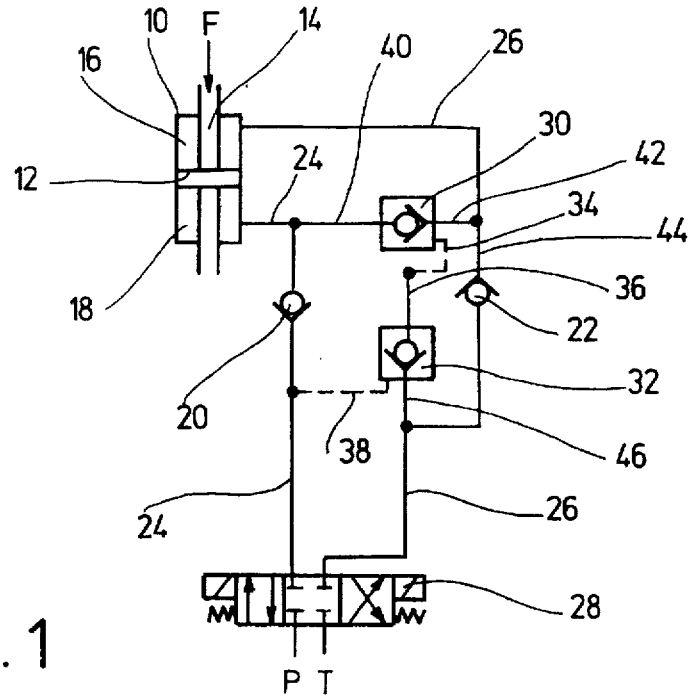
FIG. 1 is a schematic diagram of a diverting device including hydraulically openable nonreturn valves according to the present invention.

The switching device according to the present invention controls at least one hydraulically operated apparatus formed of a double-acting hydraulic cylinder 10. Inside cylinder 10, a piston 12 is held and is longitudinally movable. A piston rod 14 projects outwardly on both sides or ends of hydraulic cylinder 10, and is connected with piston head 12. Piston rod 14 serves for introduction of the force. Piston head 12 subdivides hydraulic cylinder 10 into the two work chambers 16 and 18. On its two sides facing work chambers 16 and 18, the piston head has piston surfaces of identical dimensions.

The switching device has two nonreturn or check valves 20 and 22 operating counter to one another in a feed conduit 24 and discharge conduit 26. The conduits are connected in turn to the operating apparatus as well as to a pilot valve 28. Pilot valve 28 is configured as a sliding valve, especially as a 4/3-way valve. In its middle setting, in other words its middle switching or adjusting position, the pilot valve separates feed conduit 24 and discharge conduit 26 from a hydraulic pump P and a tank T.

Parallel to both nonreturn valves 20 and 22 of traditional construction, two openable nonreturn valves 30 and 32 are located. The control conduit 34 of the first openable nonreturn valve 30 is connected to the blocking connection 36 of the second openable nonreturn valve 32.

The two nonreturn valves 30 and 32 can be opened hydraulically. Control conduit 38 of second openable nonreturn valve 32 opens between first nonreturn valve 20 and pilot valve 28 in feed conduit 24. Blocking connection 40 of first openable nonreturn valve 30 opens in the direction of fluid flow behind first nonreturn valve 20 in feed conduit 24 feeding hydraulic cylinder 10. Flowthrough connection 42 of first openable nonreturn valve 30 is connected to flowthrough connection 44 of second nonreturn valve 22 in discharge conduit 26. Discharge conduit 26 is connected to flowthrough connection 46 of second openable nonreturn valve 32.

If pilot or sliding valve 28 is brought into its switching position on the left, as seen in FIG. 1, pressure fluid, usually in the form of hydraulic oil, flows from hydraulic pump P through feed conduit 24 and first nonreturn valve 20 into work chamber 18 of hydraulic cylinder 10. Piston rod 14 then moves upwardly as seen in FIG. 1. The recycle oil flows out of work chamber 16 of hydraulic cylinder 10 through discharge conduit 26 and through the automatically opening second nonreturn valve 22 into tank T. As a result of the rising fluid pressure in feed conduit 24, second hydraulically openable nonreturn valve 32 is opened through control conduit 38. Since return/recycle or discharge conduit 26 is not effected by pressure during this portion of the cycle, no pressure is now generated in blocking connection 36 of second openable nonreturn valve 32 such that first openable nonreturn valve 30 remains closed. A force F, as indicated in FIG. 1, works or is applied on piston rod 14. First nonreturn valve 20 closes and first openable nonreturn valve 30 remains closed, while piston 12 is held in its proper position at this time by the load force F, even when pilot valve 28 again assumes its middle switching position or adjustment position shown in FIG. 1.

If pilot valve 28 is brought into either its right end position or its second switching position shown in FIG. 1, discharge conduit 26 is connected with hydraulic pump P to carry fluid. If the pressure which can be produced by hydraulic pump P in discharge conduit 26 exceeds a predetermined threshold value, for instance becomes greater than 10 bar, the second openable nonreturn valve 32 is operated through the flowthrough connection 46. As a result of the fluid pressure arising in blocking connection 36 and control conduit 34, the first openable nonreturn valve 30 is likewise opened. This opening process also occurs even when no pressure is found in control conduit 38. Because of the pressure from hydraulic pump P rising at the same time on second nonreturn valve 22 in discharge conduit 26, nonreturn valve 22 remains closed and the two work chambers 16 and 18 of the operating apparatus are connected with one another through the opened first openable nonreturn valve 30 carrying fluid of comparable pressure. An oil volume is introduced into blocking connection 36 and into control conduit 34 in this diverted position, whereupon the switch position "drop" is temporarily stored and the float position is obtained for piston 12 of the hydraulic cylinder. This float position is also retained when the operating mechanism of pilot valve 28 no longer operates and the pilot valve moves back into its middle resting or adjustment position, as a result of the pilot valve being for instance spring-biased, as shown in FIG. 1.

When the described float position and renewed lifting occurs again, pilot or sliding valve 28 is brought back into its left switching position shown in FIG. 1. In this case, then, the pressure rises once again in feed conduit 24, so that in addition to the operation of first nonreturn valve 20, control conduit 38 is acted upon in such a manner with pressure that openable second nonreturn valve 32 opens. In this opened position and with discharge conduit 26 being without pressure, the fluid being at this time under pressure flows into control conduit 34 through block connection 36 and second openable nonreturn valve 32 and into discharge conduit 26. Such flow causes first hydraulically openable nonreturn valve 30 to close. The oil, then, which has until this time been spreading between the two hydraulically openable nonreturn valves 30 and 32 for storage for the float position, can be allowed to flow back to tank T. Thus, two work chambers 16 and 18 of hydraulic cylinder 10 are once again separated from each other and the aforementioned lifting and holding process can be repeated.

Figure 2:
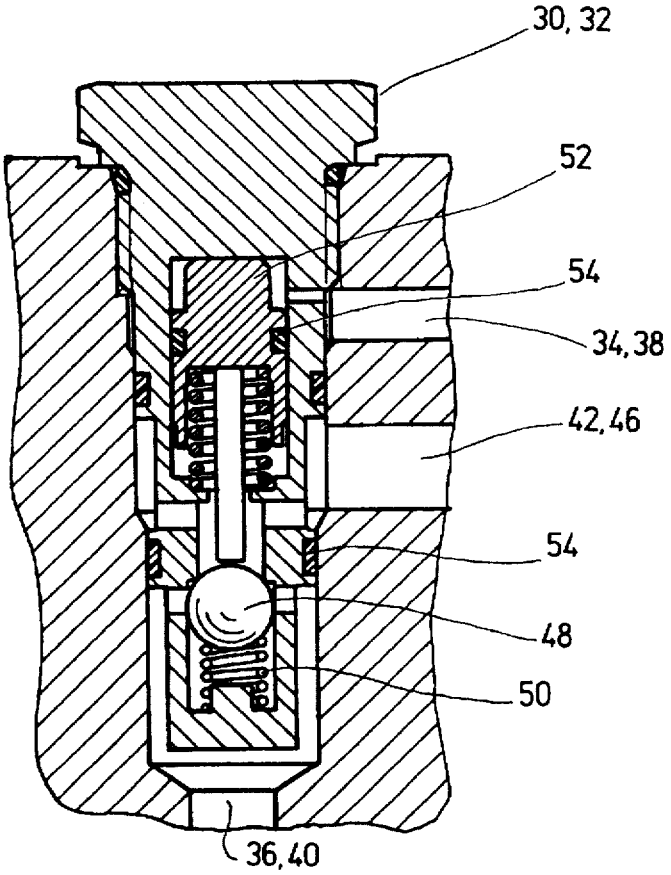
FIG. 2 is a side elevational view in section of the hydraulically openable nonreturn valve used in the circuit of FIG. 1.

A hydraulically openable nonreturn valve is shown in FIG. 2, preferably as it is used in the switching device of FIG. 1. Each of the openable nonreturn valves 30 and 32 is in the form of a directly controlled ball seat valve with a closing ball 48 for oil-hydraulic assemblies. Each valve allows unhindered flowthrough in flowthrough direction from the flowthrough connection 42 or 46 to blocking connection 36 or 40. In the opposite direction, closing ball 48 is pressed onto the valve seat by the closing spring 50 and by pressure on blocking connection 36, 40, where it blocks the aforementioned flowthrough direction, freeing it of leakage oil. With introduction of a sufficiently high operating pressure at that control conduit 34 or 38, control piston 52 is then thrust forward and closing ball 48 is pressed from its valve seat. The valve is then hydraulically opened and flow can occur from blocking connection 36 or 40 to the associated flowthrough connection 42 or 46.

In the case of pressure release, the return spring arranged under control piston 52 allows control conduit 34 or 38 to undergo a switching back or reconnection with the original connection without any delay. To reliably occlude the oil volume in control conduit 34 and blocking connection 36 between the two hydraulically openable nonreturn valves 30 and 32, the relevant openable nonreturn valve 30 or 32, as shown in FIG. 2, has a seal 54, for example in the form of a traditional O-ring, on that control piston 52 between the relevant control conduit 34 or 38 and the associated flowthrough connection 42 or 46, as well as between the associated blocking connection 36 or 40.

The described switching device can be used especially advantageously in agricultural machinery. A work tool or instrument, such as a plow or a tedder, has to remain in constant engagement or in contact with the terrain to be worked. With this switching device several operating apparatuses, for example assembled in parallel and in sequence one after the other, and arranged in connection with one another, can also be arranged to obtain a floating mounting of the working tool or instrument. Of course other uses of the switching device are also possible, for instance in road construction or road repair machinery, as well as in cargo trucks.

While a particular embodiment has been chosen to illustrate the invention, it will be understood by those skilled in the art that various changes and modifications can be made therein without departing from the scope of the invention as defined in the appended claims.

What is claimed is:

1. A switching device for controlling a hydraulically operated apparatus, comprising:

a feed conduit having a first check valve therein;

a discharge conduit having a second check valve therein;

at least one hydraulically operated apparatus connected to said feed conduit and said discharge conduit, said hydraulically operated apparatus being a double acting hydraulic cylinder having a piston rod and first and second work chambers coupled to said feed conduit and said discharge conduit, respectively;

a pilot valve connected to said feed conduit and said discharge conduit; and first and second openable, nonreturn valves connected in parallel to said first and second check valves, each of said nonreturn valves having a control conduit, a flowthrough connection, and a blocking connection, said control conduit of said first nonreturn valve being connected to said blocking connection of said second nonreturn valve, said control conduit of said second nonreturn valve being connected to and opening into said feed conduit between said pilot valve and said first check valve, said blocking connection of said first nonreturn valve being connected to and opening into said feed conduit in a direction of fluid flow and between said first check valve and said hydraulic cylinder.

2. A switching device according to claim 1 wherein each of said first and second check valves comprises a flowthrough connection and a blocking connection;

said flow through connection of said first nonreturn valve is connected by said discharge conduit to said flowthrough connection of said second check valve; and said discharge conduit is connected to said flowthrough connection of said second nonreturn valve.

3. A switching device according to claim 1 wherein said pilot valve is a 4/3-way sliding valve having first end, middle and second end switching positions; and in said middle switching position, said pilot valve separates said feed conduit and said discharge conduit from a hydraulic pump and a tank coupled to said pilot valve.

4. A switching device according to claim 3 wherein in said first end position, said pilot valve connects said feed conduit to said pump for raising and holding said piston rod of said hydraulic cylinder, for opening said second nonreturn valve and for maintaining said first nonreturn valve closed; and in said second end position and in said middle position after being in said second end position of said pilot valve, said first and second nonreturn valves are opened to connect said first and second work chambers, if a predetermined work pressure is applied to said piston rod, for conveying fluid pressure between said work chambers.

5. A switching device according to claim 4 wherein fluid pressure in said work chambers exceeds 10 bar; and said pilot valve comprises means for automatically moving said pilot valve into said middle position upon nonoperation of a switching cycle.

6. A switching device according to claim 1 wherein each of said nonreturn valves is hydraulically operable, and comprises a control piston with at least one seal separating said control conduit from said flowthrough connection thereof, without leakage.

7. A switching device for controlling a hydraulically operated apparatus, comprising:

a feed conduit having a first check valve therein;

a discharge conduit having a second check valve therein;

at least one hydraulically operated apparatus connected to said feed conduit and said discharge conduit, said hydraulically operated apparatus being a double acting hydraulic cylinder having a piston rod and first and second work chambers coupled to said feed conduit and said discharge conduit, respectively;

first and second openable, nonreturn valves connected in parallel to said first and second check valves, each of said nonreturn valves having a control conduit, a flowthrough connection, and a blocking connection, said control conduit of said first nonreturn valve being connected to said blocking connection of said second nonreturn valve; and a pilot valve connected to said feed conduit and said discharge conduit, said pilot valve being a 4/3-way sliding valve having first end, middle and second end switching positions;

in said middle switching position, said pilot valve separating said feed conduit and said discharge conduit from a hydraulic pump and a tank coupled to said pilot valve;

in said first end position, said pilot valve connecting said feed conduit to said pump for raising and holding said piston rod of said hydraulic cylinder, for opening said second nonreturn valve and for maintaining said first nonreturn valve closed;

in said second end position and in said middle position after being in said second end position of said pilot valve, said first and second nonreturn valves being opened to connect said first and second work chambers, if a predetermined work pressure is applied to said piston rod, for conveying fluid pressure between said work chambers.

8. A switching device according to claim 7 wherein said control conduit of said second nonreturn valve is connected to and opens into said feed conduit between said pilot valve and said first check valve; and said blocking connection of said first nonreturn valve is connected to and opens into said feed conduit in a direction of fluid flow and between said first check valve and said hydraulic cylinder.

9. A switching device according to claim 8 wherein each of said first and second check valves comprises a flowthrough connection and a blocking connection;

said flow through connection of said first nonreturn valve is connected by said discharge conduit to said flowthrough connection of said second check valve; and said discharge conduit is connected to said flowthrough connection of said second nonreturn valve.

10. A switching device according to claim 7 wherein fluid pressure in said work chambers exceeds 10 bar; and said pilot valve comprises means for automatically moving said pilot valve into said middle position upon nonoperation of a switching cycle.

11. A switching device according to claim 7 wherein each of said nonreturn valves is hydraulically operable, and comprises a control piston with at least one seal separating said control conduit from said flowthrough connection thereof, without leakage.

* * * * *